US005277373A

United States Patent [19]

Morton

[11] Patent Number: 5,277,373

[45] Date of Patent: Jan. 11, 1994

[54] APPARATUS AND METHOD FOR CONTROLLING TENSION IN A MOVING MATERIAL

[76] Inventor: Henry H. Morton, 100 Covington St., Wadesboro, N.C. 28170

[21] Appl. No.: 809,949

[22] Filed: Dec. 18, 1991

[51] Int. Cl.[5] ..... B65H 59/38

[52] U.S. Cl. ..... 242/45; 226/44

[58] Field of Search ..... 242/45, 75.51, 75.52, 242/75.5; 226/44, 45

[56] References Cited

U.S. PATENT DOCUMENTS

| | | | |
|---|---|---|---|
| 2,275,192 | 3/1942 | Bailey | 242/45 |
| 3,060,357 | 10/1962 | Lohest | 242/45 X |
| 3,233,397 | 2/1966 | Bonikowski | 242/45 X |
| 3,537,660 | 11/1970 | Schippers et al. | 242/45 |
| 3,638,873 | 2/1972 | Cole | 242/45 |
| 3,670,975 | 6/1972 | Tomimatsu | 242/45 |
| 3,931,938 | 1/1976 | Hasegawa et al. | 242/45 |
| 4,169,565 | 10/1979 | Blok | 242/45 X |
| 4,566,646 | 1/1986 | Benjamin | 242/45 |
| 4,623,101 | 11/1986 | Cacak | 242/45 |
| 5,080,296 | 1/1992 | Raggio et al. | 242/45 |

*Primary Examiner*—Stanley N. Gilreath
*Attorney, Agent, or Firm*—W. Thad Adams, III

[57] ABSTRACT

A tension control apparatus for a material winder of the type including a material supply package and a material take-up package, an electric motor for driving the take-up package and a tension responsive dancer arm positioned intermediate the material supply package and the material take-up package for angular movement about an axis proportional to tension variation in the moving material. The tension control apparatus includes a polar magnet mounted for axial rotation about the axis of movement of the dancer arm in fixed relation to the movement of the dancer arm about the axis. A magnetic angular position sensor is positioned in magnetic field sensing relation to the polar magnet for sensing the change in the angular position of the polar magnet responsive to tension variation in the moving material and outputting an electrical signal proportional to the angular position of the polar magnet. A signal processing feedback circuit receives and processes the electrical signal and outputs a voltage and current as required to vary the speed of the motor to maintain constant tension.

21 Claims, 3 Drawing Sheets

APPARATUS AND METHOD FOR CONTROLLING TENSION IN A MOVING MATERIAL

TECHNICAL FIELD AND BACKGROUND OF THE INVENTION

This invention relates to an apparatus and method for controlling tension in a moving material. Industries that use or produce fibers or materials utilize many forms of winding apparatus to wind the material or product onto spools or rolls. Fibrous materials may be natural or synthetic thread, yarn, rope, wire, or the like. Material products may be woven cloth, webbing, pliable sheet plastic, fibrous substances, sheet metal or the like.

The particular disclosure of this application is directed to a winder of the type used to wind yarn or thread. However, it is understood that the invention has application to winding in general to the extent that the particular winding process is enhanced by control of the tension generated by the winding process.

It is usually desirable to maintain a preset tension on the yarn while it is wound to insure a compact and uniformly wound package. Typically the supply of product to be wound flows from a supply source such as a supply package or the actual production process such as extrusion from a synthetic fiber extruder. The yarn then goes through a slack take-up-and-tensioning mechanism (commonly called "dancer") to maintain the proper "pull" on the product. From there the product moves to a motor-driven take-up spool or roller mechanism, usually referred to as a take-up package.

The quality of the yarn on the take-up package and the uniformity of downstream processes is often directly dependant on the uniformity of the tension on the yarn on the take-up package. For example, areas of too tightly wound yarn on a package can cause light spots after the yarn on the package is dyed. Excess tension also can cause increased wear on guides, bearings and other downstream processing equipment.

The objective therefore is to keep the tension constant. The yarn flows from the supply package at a speed that is determined by the rate at which the take-up package is driven and the diameter of the take-up package. The speed may be fixed or variable. In order to maintain constant tension the speed of the take-up mechanism must be constantly regulated to follow the supply speed so that the yarn exerts a relatively constant force against the tensioning mechanism. The tensioning mechanism is typically a movable roller in the case of sheet materials or a pulley on a movable arm in the case of yarn or thread. The tensioning mechanism is spring-loaded and is typically called a dancer arm. Its position depends upon the force exerted on it by the yarn, so that an increase in tension will pull the dancer arm in one direction and a decrease in tension will allow the dancer arm to move in the opposite direction.

Prior art systems are known wherein a position sensing device is applied to the dancer arm. The position sensing device output is compared to a set value and the resulting signal value is used to control the electric power going to the take-up spindle motor. This comprises a closed-loop feedback system that makes whatever changes in motor power that are necessary in order to maintain a constant position of the tensioning mechanism and consequently constant tension on the product.

This type of take-up machine has been in use for many years. However, various prior embodiments have suffered from numerous disadvantages and problems:

1. The complexity of the position sensing device makes it difficult to install and adjust;
2. Sensor failures occur frequently because the mechanical linkages and constantly switching electrical contacts are prone to wear;
3. System components are expensive to replace;
4. Component replacement is time-consuming; and
5. The accuracy of the system is limited by the condition known as "hunting", where the tensioning mechanism constantly oscillates above and below the desired setpoint causing nonuniformity in the wound product package;

A survey of yarn fiber winding industry suppliers and users points to the definite need for a modern electronic device to address these problems. Thousands of yarn winders are in use currently with old technology tension control devices. Replacement parts are scarce and expensive. Present day quality control standards call for yarn product uniformity that is not achievable using old winding tension control technology.

SUMMARY OF THE INVENTION

Therefore, it is an object of the invention to provide a tension control apparatus which is extremely simple to install and adjust since there is no direct mechanical contact between the sensor and the tensioning mechanism, referred to herein as the "dancer arm."

It is another object of the invention to provide a tension control apparatus wherein, since there is no mechanical wear on the sensor, its life expectancy is indefinite.

It is another object of the invention to provide a tension control apparatus which uses inexpensive components throughout so servicing costs are minimal.

It is another object of the invention to provide a tension control apparatus which can output reference signals to a variety of devices such as AC or DC motors, clutches, brakes and many other types of operating devices.

It is another object of the invention to provide a tension control apparatus wherein complete unit replacement, in case of failure, is quickly accomplished so that down-time is drastically reduced.

It is another object of the invention to provide a tension control apparatus in which operation is smooth and consistent allowing precision winding.

It is another object of the invention to provide tension control apparatus which can be easily retrofitted to existing winders quickly and simply.

It is another object of the invention to provide a method of controlling tension which accomplishes the advantages and purposes set out above.

These and other objects of the present invention are achieved in the preferred embodiments disclosed below by providing a tension control apparatus for a material winder of the type including a material supply package and a material take-up package, electric motor means for driving the take-up package and a tension responsive dancer arm positioned intermediate the material supply package and the material take-up package for angular movement about an axis proportional to tension variation in the moving material. The tension control apparatus includes polar magnetic means mounted for axial rotation about the axis of movement of the dancer arm in fixed relation to the movement of the dancer arm about the axis. Magnetic angular position sensing means are positioned in magnetic field sensing relation to the polar magnetic means for sensing the change in the angular position of the polar magnetic means responsive to tension variation in the moving material and outputting an electrical signal proportional to the angular position of the polar magnetic means. Signal processing feedback circuit means receive and process the electrical signal and output a voltage and current as required to vary the speed of the motor means to maintain constant tension.

According to one preferred embodiment of the invention, the electric motor means comprises a direct current motor.

According to another preferred embodiment of the invention, the electric motor means comprises an alternating current motor.

According to yet another preferred embodiment of the invention, the signal processing feedback circuit means includes rate detecting means for measuring the rate at which the dancer arm is moving towards a predetermined set point and calculating the time of arrival of the dancer arm at the predetermined set point.

According to one preferred embodiment of the invention, the signal processing feedback circuit means includes integrating means for smoothing variations in the electrical signal caused by spurious inputs.

According to another preferred embodiment of the invention, the signal processing feedback circuit means includes a phase angle circuit for supplying power to the motor means proportional to the signal from the integrating means.

According to another preferred embodiment of the invention, the signal processing feedback circuit means includes set point means for fixing a set point representing an ideal dancer arm position and tension.

According to several alternative embodiments of the invention the material comprises a material selected from the group consisting of thread, yarn, rope, wire, cloth, webbing plastic sheet material and metal sheet material.

An embodiment of the method according to the invention related to controlling tension of material being wound on a material winder of the type including a material supply package and a material take-up package, electric motor means for driving the take-up package and a tension responsive dancer arm positioned intermediate the material supply package and the material take-up package for angular movement about an axis proportional to tension variation in the moving material. The method includes the steps of providing polar magnetic means mounted for axial rotation about the axis of movement of the dancer arm in fixed relation to the movement of the dancer arm about the axis, sensing the change in the angular position of the polar magnetic means responsive to tension variation in the moving material, outputting an electrical signal proportional to the angular position of the polar magnetic means, receiving and processing the electrical signal; and outputting a voltage and current as required to vary the speed of the motor means to maintain constant tension.

According to one preferred embodiment of the invention, the method includes the step of outputting the voltage and current to a direct current motor.

According to another preferred embodiment of the invention, the method includes the step of outputting the voltage and current to an alternating current motor.

According to yet another preferred embodiment of the invention, the method includes the steps of measuring the rate at which the dancer arm is moving towards a predetermined set point and calculating the time of arrival of the dancer arm at the predetermined set point.

According to yet another preferred embodiment of the invention, the method includes the step of integrating means for smoothing variations in the electrical signal caused by spurious inputs.

According to yet another preferred embodiment of the invention, the method includes the step of supplying power to the motor means proportional to the signal from the integrating means.

According to yet another preferred embodiment of the invention, the method includes the step of fixing a set point representing an ideal dancer arm position and tension.

BRIEF DESCRIPTION OF THE DRAWINGS

Some of the objects of the invention have been set forth above. Other objects and advantages of the invention will appear as the invention proceeds when taken in conjunction with the following drawings, in which.

DESCRIPTION OF THE PREFERRED EMBODIMENT AND BEST MODE

Figure 1:
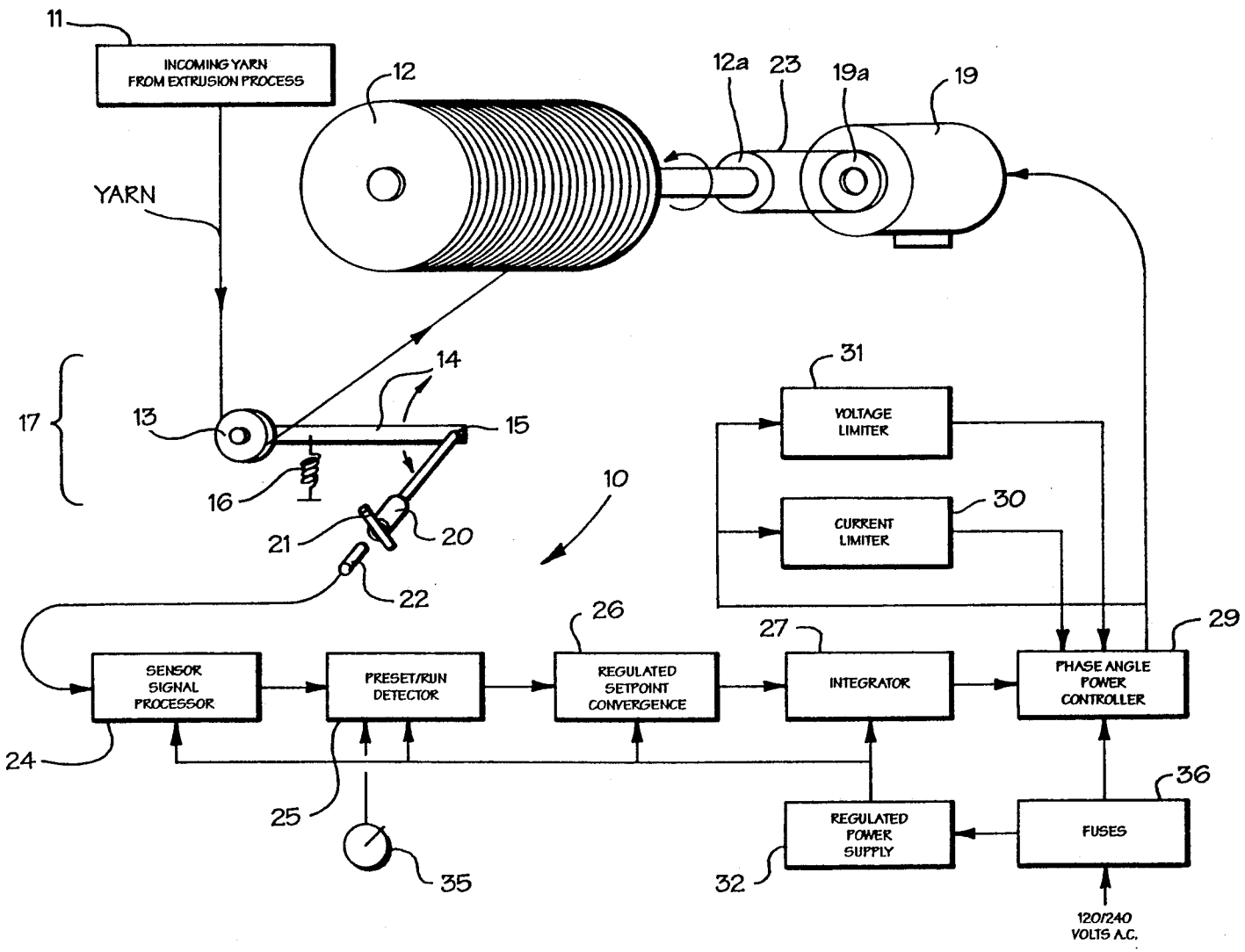
FIG. 1 is a simplified schematic view of the tension controller according to a preferred embodiment of the invention.

Referring now specifically to the drawings, a tension control apparatus according to the present invention is illustrated in FIG. 1 and shown generally at reference numeral 10. For purposes of illustration a yarn from an extrusion apparatus 11 is to be wound onto a take-up package 12. Between the extrusion apparatus 11 and take-up package 12 the yarn is passed under a pulley 13 attached for rotation on the end of a lever arm 14. Lever arm 14 is pivoted for rotation about a pivot axis 15. A spring 16 or other biasing means applies tension to the lever arm 14.

The elements 13–16 inclusive are referred to as the dancer arm 17 below.

Yarn is delivered to the take-up roll 12 of the winder at a variable rate from the extrusion process 11. The winder must maintain constant tension on the yarn throughout the winding process. The yarn passes under the pulley 13 of the dancer arm 17 and then onto the take-up roll 12. A take-up motor 19 rotates the take-up roll 12 through suitable power transfer means, such as a pulley 19A which rotates a take-up pulley 12A through an endless belt 23. The tension control apparatus 10 must drive the take-up motor 19 at exactly the right speed to match the yarn feed rate and at the same time keep just the right tension on the yarn. The yarn exerts upward force on the pulley 13 proportional to the speed of motor 19 and in so doing biases the spring-loaded lever arm 14 to the proper point. Greater yarn tension results if the lever arm 14 is pulled higher, and lesser yarn tension results if the lever arm 14 is pulled lower.

The position of the lever arm 14 is monitored by a magnetic angular position sensor 20 mounted for rotation with the pivot axis of the lever arm 14. The magnetic angular position sensor 20 includes a polar bar magnet 21 which has a fixed direction of magnetic attraction along its length. Magnet 21 rotates as lever arm 14 pivots. The rotation of magnet 21 causes the direction of magnetic attraction to rotate as well.

A magnetic angular position sensor 22 is positioned in close proximity to the magnet 21. Sensor 22 delivers an analog voltage output signal proportional to the position of the lever arm 14. This signal is fed to a sensor signal processor 24 where it is constantly compared to a setpoint to determine if the position of the lever arm 14 is correct and therefore applying the proper tension to the yarn.

If the tension is not correct then the power to the motor 19 is increased or decreased accordingly to return the lever arm 14 to its proper position.

In this way the tension control apparatus 10 can maintain constant tension even though there are variations in feed-rate, machine friction, utility supply voltage loads, etc. Also, as the yarn take-up package 12 increases in diameter the motor speed 19 must decrease in order to keep the same surface speed. The tension control apparatus makes this correction.

A typical high-gain closed-loop feedback system such as this gives rise to oscillations. Without some compensation, the inertia of the motor armature, belts, pulleys and take-up roll causes a time lag between a change in power fed to the motor 19 and the corresponding change in the speed of the take-up roll. This means that the motor 19 power level will have been driven past that required for correction before correction is realized so overcorrection will result. This now causes a need to correct in the other direction, and that will again result in over-correction, and so on. This oscillation above and below setpoint is called "hunting".

To prevent "hunting" a conventional control system includes circuitry that employs parametric vectors known as proportional, integral, derivative (PID).

In contrast, tension control apparatus 10 includes circuitry to accomplish the same results by measuring the rate at which the correcting motion of the lever arm 14 is converging on the desired setpoint and then anticipating its arrival at the setpoint.

The setpoint is set by a preset/run detector circuit 25.

A regulated setpoint convergence circuit 26 outputs a signal which is used to control the power of motor 19 to regulate that convergence. This is termed "regulated setpoint convergence" (RSC).

The output of the RSC circuit 26 is fed to an integrator circuit 27 which smoothes the signal, filtering out the "noise" caused by mechanical vibrations in the arm movement. The signal is then sent to a phase-angle power controller circuit 29. The phase-angle power controller circuit 29 supplies power to the motor 19 that is some proportion between 0 and 100% of the available power coming in from the utility supply. The incoming signal from integrator circuit 27 determines the timing of the firing of thyristors in a the phase-angle power circuit 29 that pass the current through to the motor 19. This timing determines when current is on and when it is off. Varying the on/off ratio controls the total power to the motor 19 and thus its speed. The voltage and the current delivered to the motor is monitored by a current limiter circuit 30 and a voltage limiter circuit 31. The motor 19 is thus prevented from exceeding preset safe limits. A regulated power supply circuit 32 reduces the incoming utility voltage down to 12 volts DC to power the circuitry. Conventional power supplies utilize a transformer for this reduction.

The tension controller apparatus 10 according to this invention incorporates a "series pass power FET" switching supply in the regulated power circuit 32 to eliminate the weight and bulk of a transformer. This regulated power supply circuit 32 also adds the benefit of automatically adjusting to various input supply voltages. A transformer supply typically requires a 120/240 V switch but this regulated power supply circuit 32 will accept 50–280 VAC and still deliver 12 VDC out.

When the winder is first started and before the yarn is threaded, the take-up roll 12 must rotate at a surface speed slightly above the feed-rate so that when the yarn is threaded onto the roll 12 the slack will be taken up and a tight first wrap will be insured. When the tension control apparatus is powered-up the motor 19 will rotate at a fixed rate as set by the speed set control 35. When the yarn is threaded onto the take-up roll 12 the lever arm 14 will move up quickly. This transition is detected by the preset/run detector circuit 25 and the preset speed is then disengaged so the motor 19 can follow the lever arm 14 position through the circuitry described above.

Electrical fuses 36 protect the circuitry from overload.

Figure 2:
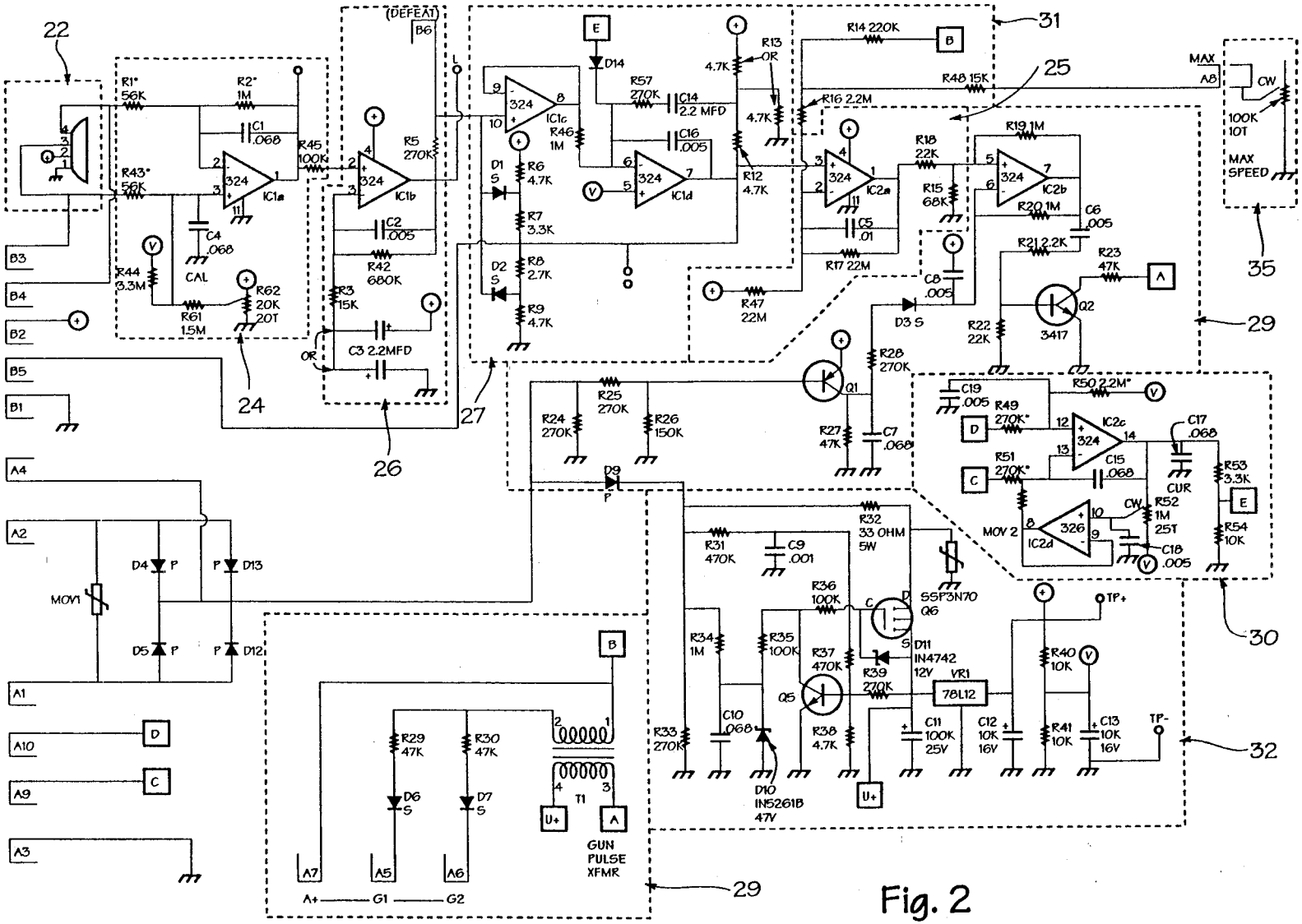
FIG. 2 is a schematic diagram of the sensor signal processor.

More specific reference is now made to the sensor 22 and circuits 24–31 illustrated diagrammatically in FIG. 2. The sensor 22 is a semiconductor Hall effect device with a differential output. When this sensor 22 is placed perpendicular to a magnetic field, as provided by the bar magnet 21, the differential output voltage amplitude and polarity are dependent upon the angular relationship between the face of the sensor 22 and the magnetic lines of force of the sensor 22.

The semiconductor Hall effect device responds to a magnetic field by outputting a voltage proportional to the polarity and strength of the magnetic field present at the sensor face. If two Hall effect devices are joined on their respective faces, then their respective output change will be equal but opposite in direction. A small bar magnet suspended over the Hall effect devices and oriented in a parallel plane to their respective faces will result in no change in the output as compared to no field present. However, angular rotation of the axis of the magnet with respect to the plane of the faces will result in a change of both outputs in opposite directions. If the two outputs are fed to a differential amplifier then its output direction change and amplitude change indicate angular direction and angle magnitude, respectively.

The differential signal is amplified and scaled by the differential amplifier comprised of operational amplifier IC1-*a* (24), resistors R1, R2, R43 and R44. Capacitors C1 and C4 filter out high frequency noise. Resistor R61 and potentiometer R62 provide calibration adjustment to correct for manufacturing tolerances in the sensor.

Operational amplifier IC1-*b*, C3, R3, R42, R45 and C2 (25) comprise the convergence rate detector. Through R5, buffer IC1-*c* and R46 the rate signal controls the integrator 27 comprised of IC1-*d*, C14, and resistors R57, R13, R12 and C16 to anticipate and regulate setpoint convergence 26. Resistors R6, R7, R8, R9, D1 and D2 limit the minimum and maximum output of the integrator circuit 27. The output signal at IC1-*d* pin 7 represents the speed command for the motor 19. Since a DC motor's speed is proportional to motor voltage this speed reference is compared to the actual motor voltage by IC2-*a*, R47, R16, R14, R17 and C5. R48 (31) and MAX speed rheostat (35) calibrate maximum motor voltage. The error that exists between commanded motor voltage and actual motor voltage is represented by a signal at IC2-*a* pin 1. This signal controls the timing for the thyristor-firing pulse generator comprised of IC2-*b*, resistors R15, R18, R19, R20 and C8. A zero-crossing detector comprised of resistors R24, R25, R26, Q1, R27, C7, R28 and D3 synchronizes the pulse timing with the AC supply phase timing C6, R21, R22, Q2 and R23 comprise a pulse shaper in phase angle power controller 29 to drive pulse transformer T1. The output pulses of T1 pass through R29, R30, D6 and D7 to the gates of thyristors.

All of the current flowing through the motor armature must pass through a printed circuit board foil trace that serves as a shunt resistor. The differential amplifier comprised of IC2-*c*, R49, R51, R50, R55, IC2-*d*, C15, C17, C18 and R52 connects across the ends of that foil trace to measure the voltage resulting from that current flow. This signal is divided by R53 and R54 and passed through D14 to IC1-*d* to serve as current limit 30. Potentiometer R52 allows adjustment of maximum motor current.

A series-pass two-stage switching voltage regulator (regulated power supply 32) is comprised of R31, C9, R32, Q6, Q5, R33, R34, R35, R36, R37, R38, R39, D11, C11, VR1, C12, C10 and D10. MOV2 limits incoming powerline high-voltage transients that could damage Q6. D9 prevents backflow into the Q1 detector. The output of this supply is 12 volts DC and powers all the signal circuitry. The advantage of this supply design is that it will accept any input voltage from 50–280 volts and still deliver 12 volts output. R40, R41 and C13 comprise a 6 volt reference supply. MOV1 suppresses incoming power-line high-voltage transients to prevent them from causing dV/dT false triggering of the thyristors. D4 and D5 rectify line voltage to provide supply current to the DC motor's field coil if that type motor is used. D12 and D13 rectify the line voltage to provide the pulsating DC for line sync and the switching power supply.

FIG. 2 illustrates, schematically, the elements of the invention shown in block diagram form in FIG. 1. Element 24, the sensor signal processor, includes integrated circuit 1*a* (IC1-*a*). As marked specifically in phantom, the circuit 25 is included in FIG. 2. The preset/run detector 25 includes IC2-*a*. Element 26, the regulated setpoint convergence, includes IC1-*b*. The integrator 27 is comprised of IC1-*d*, C14, and resistors R57, R13, R12, and C16. The phase angle power controller 29 is shown schematically in FIGS. 2 and 3, and each of the outlined portions referenced at numeral 29 of FIGS. 2 and 3 comprise the phase angle power controller 29. IC2-*c* and IC2-*d* comprise the current limiter 30. The voltage limiter 31 includes IC2-*a*. Element 32, the regulated power supply, includes Q5, Q6, and VR1.

Additionally, FIG. 2 illustrates the magnetic angular sensor 22, as outlined in phantom. DCD-308D is a shorthand reference for the respective element circuitry indicated in FIG. 2, simply to identify the dancer control drive circuit board. It is not intended to have a particular meaning or structure in the art.

Reference letters A—A, B—B, C—C, D—D, E—E, and U+ —U+ represent interconnection points, depicting the beginning and end of open-end points. As understood by those skilled in the art, these letters, set out in respective blocks, tie together or connect the circuitry of various elements of the invention.

Figure 3:
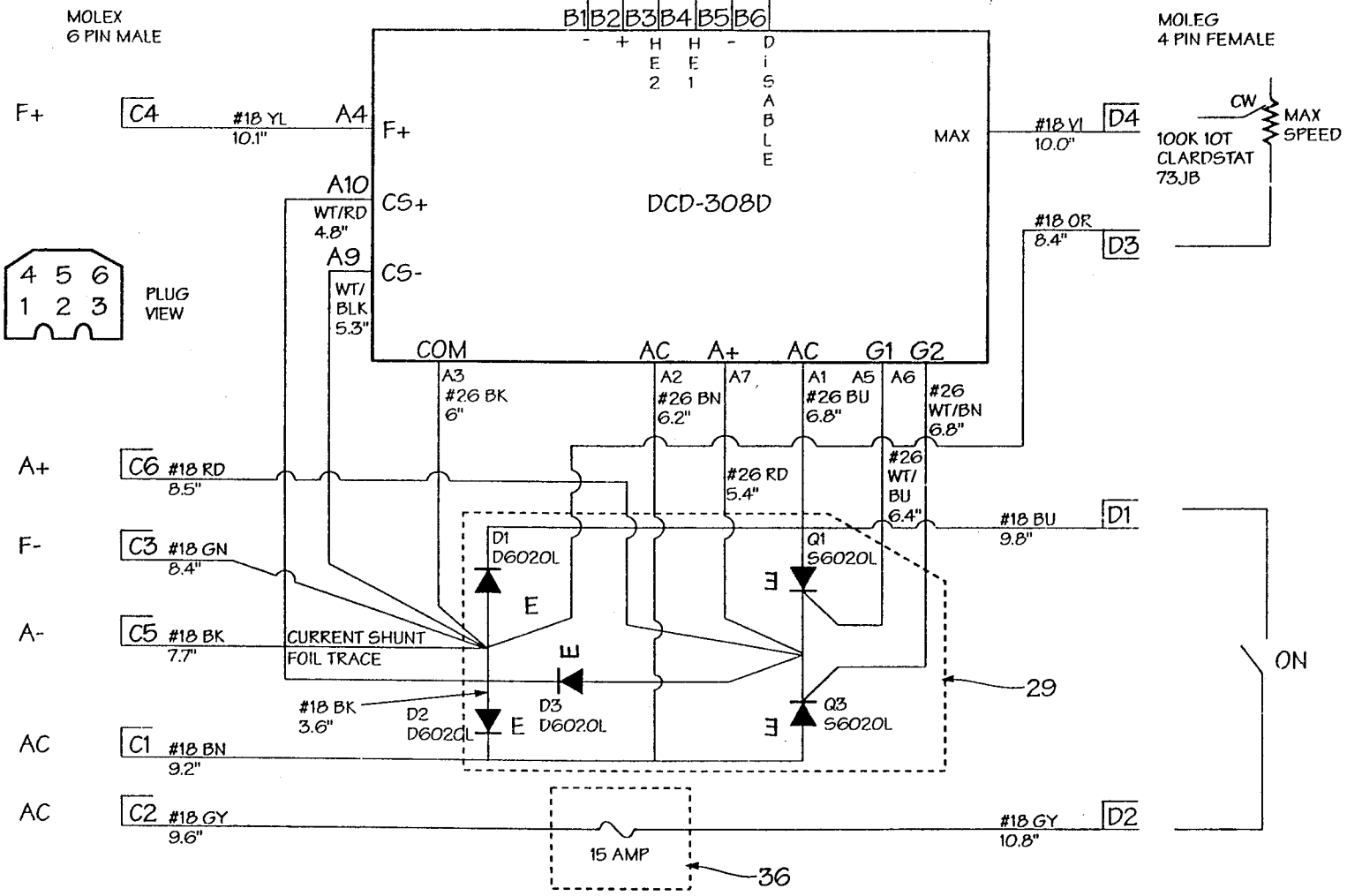
FIG. 3 is a schematic of the motor speed control circuit.

The circuit board DCD-308D represented schematically in FIG. 2, is illustrated generally in FIG. 3. As shown in FIG. 2, points indicated at B3, B4, B2, B5, A4, A2, A1, A10, A9, A3, A7, A5, and A6, and placed in blocks, correspond to like indicated connection points illustrated in FIG. 3. The circuitry referenced at B1, B2, B3, B4, B5, and B6 shown in FIG. 3 indicate test points, and have no particular bearing on the subject matter of the invention.

FIG. 3 illustrates the entire circuitry of the apparatus, including the dancer arm control board (DCD-308D) shown in FIG. 2 and described above. The DCD-308D board broadly depicts the elements specifically described and referred to in FIG. 2. A 15 amp electrical fuse 36 is shown in FIG. 3 for protecting the circuitry from overload.

The motor winding and armature winding is indicated in FIG. 3. The motor winding is presented at F— / R+, and the armature winding at A— / A+. The utility power input (AC) is likewise indicated in FIG. 3.

Referring now to FIG. 3, line voltage is rectified by a full-wave bridge comprised of D1, D2, Q1 and Q2 to provide voltage for the armature of the DC motor 19. This bridge only allows a power transfer from the power line to the motor 19 when Q1 and Q2 are conducting. These are triggered-avalanche-switching-devices which means that they behave like rectifiers when their gates receive a pulse to start them conducting. They stop conducting when current ceases. Because the incoming power line voltage is a sinusoidal 60 Hertz AC wave or the instantaneous line voltage and hence current decreases to zero at the end of each half-cycle (every one-hundred-and-twentieth of a second). When thyristor Q1 or Q2 is triggered it will only conduct until the end of the half-cycle.

To proportionally control the motor voltage of motor 19 and hence its speed, the triggering pulses to the thyristor gates are proportionally time-delayed after the beginning of each half-cycle so that conduction only occurs for the required remaining portion of the half-cycle. Occasional transient interference may inadvertently prevent a particular pulse from triggering its thyristor so the pulse generator in the DCD-308D repeats the pulse several times to insure triggering.

Diode D3 suppresses reverse-polarity transients caused by motor armature inductance back-emf. The switch shown in the diagram is in series with the power source. This switch is mechanically linked to the arm and is opened whenever the arm is all the way down and not supported by yarn. This provides automatic cutoff in case of yarn break.

The winder is stopped, no yarn is on the take-up roll. The operator lifts the arm slightly, activating the power switch, and places the arm on a temporary retainer to keep the switch engaged. The motor accelerates rapidly limited by the maximum current circuit until it reaches the maximum motor voltage as set by the Preset control. This voltage produces a surface speed on the take-up roll that is slightly faster than the yarn supply feed rate.

Referring again to FIG. 1, when the yarn is first supplied it is sucked into an aspirator device to allow handling the yarn while in motion. The operator routes the yarn under the pulley 13 on the lever arm 14 and then up over the spinning take-up package or roll 12. Friction on the empty take-up package 12 grabs the yarn and starts winding.

The lever arm quickly leaves its temporary retainer and moves up to the top mechanical stop since the take-up rate exceeded the supply feed rate. The tension control apparatus 10 senses this change in lever arm 14 position and decreases the voltage of motor 19 so the lever arm can drop toward its setpoint. This is ideally set at a "level" point. The RSC circuit 27 responds to the rate of convergence on the setpoint and changes motor voltage accordingly to effect a smooth lever arm motion to the desired position where it remains. Constant tension is now being applied to the yarn. Any deviation from this position will now be anticipated and compensated for.

When the take-up package 12 reaches capacity the operator will capture and aspirate the yarn and cut it allowing the lever arm 14 to drop down and disengage a power switch (not shown). A premature yarn break would likewise drop the lever arm 14 and shut off power.

If the yarn feed-rate changes the tension control apparatus changes correspondingly. If the yarn feed-rate slows to a stall point, the tension control apparatus 10 will slow and stall the motor 19, still maintaining lever arm 14 position. When the yarn motion restarts the tension control apparatus will start again and maintain lever arm position.

Essentially the same system can also be used in an alternating current environment utilizing an alternating current motor, such as a three phase AC torque motor. In such a case a variable 3 phase voltage output to the AC take-up motor would vary the winding rate of the take-up package 12. The output voltage would be controlled according to the signal from the bar magnet 21 and the sensor 22. Also, the same system can be used for outputting reference signals to other devices such as brakes, clutches, servomechanisms and other devices.

An apparatus and method for controlling tension in a moving material is described above. Various details of the invention may be changed without departing from its scope. Furthermore, the foregoing description of the preferred embodiment of the invention and the best mode for practicing the invention are provided for the purpose of illustration only and not for the purpose of limitation-the invention being defined by the claims.

I claim:

1. A tension control apparatus for a material winder of the type including a material supply package and a material take-up package, electric motor means for driving the take-up package and a tension responsive dancer arm positioned intermediate said material supply package and said material take-up package for angular movement about an axis proportional to tension variation in the moving material, said tension control apparatus comprising:

(a) polar magnetic means mounted for axial rotation about the axis of movement of said dancer arm in fixed relation to the movement of the dancer arm about said axis;

(b) magnetic angular position sensing means comprising a semiconductor Hall effect device having a differential output, said Hall effect device positioned in magnetic field sensing relation and in perpendicular spaced-apart isolation from the magnetic field of said polar magnetic means for sensing the change in the angular position of the polar magnetic means responsive to tension variation in the moving material and outputting an electrical signal proportional to the angular position of the polar magnetic means, said spaced-apart isolation between said polar magnetic means and said Hall effect device thereby eliminating wear and accuracy degradation caused by wear between moving parts; and (c) signal processing circuit means for receiving and processing said electrical signal and outputting a voltage and current as required to vary the speed of the motor means to maintain constant tension on said yarn.

2. A tension control apparatus according to claim 1, wherein said electric motor means comprises a direct current motor.

3. A tension control apparatus according to claim 1, wherein said electric motor means comprises an alternating current motor.

4. A tension control apparatus according to claim 1, wherein said signal processing feedback circuit means includes rate detecting means for measuring the rate at which the dancer arm is moving towards a predetermined set point and calculating the time of arrival of said dancer arm at said predetermined set point.

5. A tension control apparatus according to claim 4, wherein said signal processing feedback circuit means includes integrating means for smoothing variations in said electrical signal caused by spurious inputs.

6. A tension control apparatus according to claim 5, wherein said signal processing feedback circuit means includes a phase angle circuit for supplying power to the motor means proportional to the signal from the integrating means.

7. A tension control apparatus according to claim 1, wherein said signal processing feedback circuit means includes set point means for fixing a set point representing an ideal dancer arm position and tension.

8. A tension control apparatus according to claims 1, 2, 3, 4, 5, 6 or 7, wherein said material comprises a material selected from the group consisting of thread, yarn, rope, wire, cloth, webbing plastic sheet material and metal sheet material.

9. A method for controlling tension of material being wound on a material winder of the type including a material supply package and a material take-up package, electric motor means for driving the take-up package and a tension responsive dancer arm positioned intermediate said material supply package and said material take-up package for angular movement about an axis proportional to tension variation in the moving material, including the steps of:

(a) providing polar magnetic means mounted for axial rotation about the axis of movement of said dancer arm in fixed relation to the movement of the dancer arm about said axis;

(b) providing a semiconductor Hall effect device positioned in perpendicular spaced-apart relation to said polar magnetic means, said Hall effect device having a differential output for sensing the change in the angular position of the polar magnetic means responsive to tension variation in the moving material:

(c) outputting an electrical signal proportional to the angular position of the polar magnetic means relative to the Hall effect device;

(d) receiving and processing said electrical signal; and (e) outputting a voltage and current as required to vary the speed of the motor means to maintain constant tension.

10. A method according to claim 9, and including the step of outputting the voltage and current to a direct current motor.

11. A method according to claim 9, and including the step of outputting the voltage and current to an alternating current motor.

12. A method according to claim 9, and including the steps of:

(f) measuring the rate at which the dancer arm is moving towards a predetermined set point; and (g) calculating the time of arrival of said dancer arm at said predetermined set point.

13. A method according to claim 12, and including the step of: (h) smoothing, by integrating means, variations in said electrical signal caused by spurious inputs.

14. A method according to claim 13, and including the step of (i) supplying power to the motor means proportional to the signal from the integrating means.

15. A method according to claim 14, and including the step of (j) fixing a set point representing an ideal dancer arm position and tension.

16. A tension control apparatus for a material winder of the type including a material supply package and a material take-up package, motive means for rotating the take-up package and a tension responsive dancer arm positioned intermediate said material supply package and said material take-up package for angular movement about an axis proportional to tension variation in the moving material, said tension control apparatus comprising:

(a) position transmitting means mounted for movement responsive to and in relation to the movement of said dancer arm about said axis;

(b) position sensing means positioned in sensing relation to said position transmitting means for sensing the change in the position of said position transmitting means responsive to tension variation in the moving material and outputting an electrical signal proportional to the position of the dancer arm; and (c) signal processing feedback circuit means for receiving and processing said electrical signal and outputting a voltage and current as required to vary the operating condition of said motive means to maintain constant tension on said moving material; said signal processing feedback circuit means including rate detecting means for measuring the rate at which the dancer arm is moving towards a predetermined set point and calculating the time of arrival of said dancer arm at said predetermined set point.

17. A tension control apparatus according to claim 16, wherein said motive means comprises a direct current motor.

18. A tension control apparatus according to claim 16, wherein said motive means comprises an alternating current motor.

19. A tension control apparatus according to claim 16, wherein said signal processing feedback circuit means includes integrating means for smoothing variations in said electrical signal caused by spurious inputs.

20. A tension control apparatus according to claim 19, wherein said signal processing feedback circuit means includes a phase angle circuit for supplying power to the motive means proportional to the signal from the integrating means.

21. A tension control apparatus according to claim 16, wherein said signal processing feedback circuit means includes set point means for fixing a set point representing an ideal dancer arm position and tension.

* * * * *